US010663248B1

(12) United States Patent
Liu

(10) Patent No.: US 10,663,248 B1
(45) Date of Patent: May 26, 2020

(54) LIMB AND STRING PACK FOR CROSSBOW

(71) Applicant: Chi-Chang Liu, Taichung (TW)

(72) Inventor: Chi-Chang Liu, Taichung (TW)

( * ) Notice: Subject to any disclaimer, the term of this patent is extended or adjusted under 35 U.S.C. 154(b) by 0 days.

(21) Appl. No.: 16/542,316

(22) Filed: Aug. 16, 2019

(51) Int. Cl.
*F41B 5/12* (2006.01)

(52) U.S. Cl.
CPC ..... *F41B 5/123* (2013.01)

(58) Field of Classification Search
CPC ..... F41B 5/12; F41B 5/123
See application file for complete search history.

(56) References Cited

U.S. PATENT DOCUMENTS 5,522,373 A * 6/1996 Barnett ..... F41B 5/12 124/23.1
7,178,514 B2 * 2/2007 Chang ..... F41B 5/123 124/25
8,033,275 B2 * 10/2011 Bednar ..... F41B 5/123 124/25
8,042,530 B2 * 10/2011 Barnett ..... F41B 5/12 124/23.1
9,121,659 B1 * 9/2015 Chang ..... F41B 5/123
9,146,071 B2 * 9/2015 Liu ..... F41B 5/1403
10,139,190 B1 * 11/2018 Trpkovski ..... F41B 5/12

* cited by examiner

*Primary Examiner* — John A Ricci

(57) ABSTRACT

A limb and string pack for a crossbow includes a base which is installed to an installation recess in the front end of the barrel of the crossbow. The base includes a passage. Two links respectively extend from the base and beyond the two end openings and toward the front end of the barrel. Two limbs are connected to the two links. Two cams are respectively and pivotably connected to the two limbs. A string is connected between the two cams. Two cables respectively extend through the passage of the base and are connected to the limbs and the cams. A bolt secure the base to the links and the barrel. Another bolt secures the links to the front end of the barrel of the crossbow. The base, the links and the limbs are easily removed by unscrewing the two bolts to maintain the strings and the cables.

6 Claims, 5 Drawing Sheets

LIMB AND STRING PACK FOR CROSSBOW

BACKGROUND OF THE INVENTION

1. Fields of the Invention

The present invention relates to a crossbow, and more particularly, to a limb and string pack that is easily installed to and removed from the body of the crossbow.

2. Descriptions of Related Art

The conventional crossbow generally includes a barrel, a stock, two risers connected to the front end of the barrel, two limbs respectively connected to the two risers, two cams respectively connected to the two limbs, a string connected between the two cams, and two cables connected to the limbs and the cams. The string is pulled and positioned by a latch, and an arrow is put in the guide groove. When pulling the trigger, the string is released to shoot the arrow out. The cables and the string are installed at two different planes such that the operation of the string is not affected by the cables. The strings and cables need to be replaced and maintained frequently, and a lot of parts have to be removed from the barrel so as to allow the maintainers to replace or maintain the string and the cables.

The present invention intends to provide a limb and string pack that is installed to the barrel by bolts, and the limb and string pack can be easily installed to and removed from the body of the crossbow so as to eliminate the problems mentioned above.

SUMMARY OF THE INVENTION

The present invention relates to a limb and string pack for a crossbow, and the pack comprises a base which is installed to an installation recess in the top of the front end of the barrel of the crossbow. The installation recess includes two end openings and an open top. The base includes a passage which communicates with the two end openings of the installation recess. Two links respectively extend from the base and beyond the two end openings and toward the front end of the barrel of the crossbow. A pocket is connected to the free end each of the two links. Two limbs are connected to the two pockets and located next to the two links. Two cams are respectively and pivotably connected to the free end of the two limbs. A string is connected between the two cams and located above the barrel of the crossbow. Two cables respectively extend through the passage of the base and are connected to the limbs and the cams. A first bolt extends through the two links, the barrel of the crossbow, the installation recess and the base, and is connected with a nut. A second bolt extends through the links and the front end of the barrel of the crossbow, and is connected with another nut.

The advantages of the present invention are that the travel distance of the string is increased by the base and the two links. The pack can be easily removed from the barrel by unscrewing the two bolts, so that the string and the cables are conveniently replaced and maintained. The cables extend through the passage of the base, and do not affect operation of the string.

The present invention will become more apparent from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
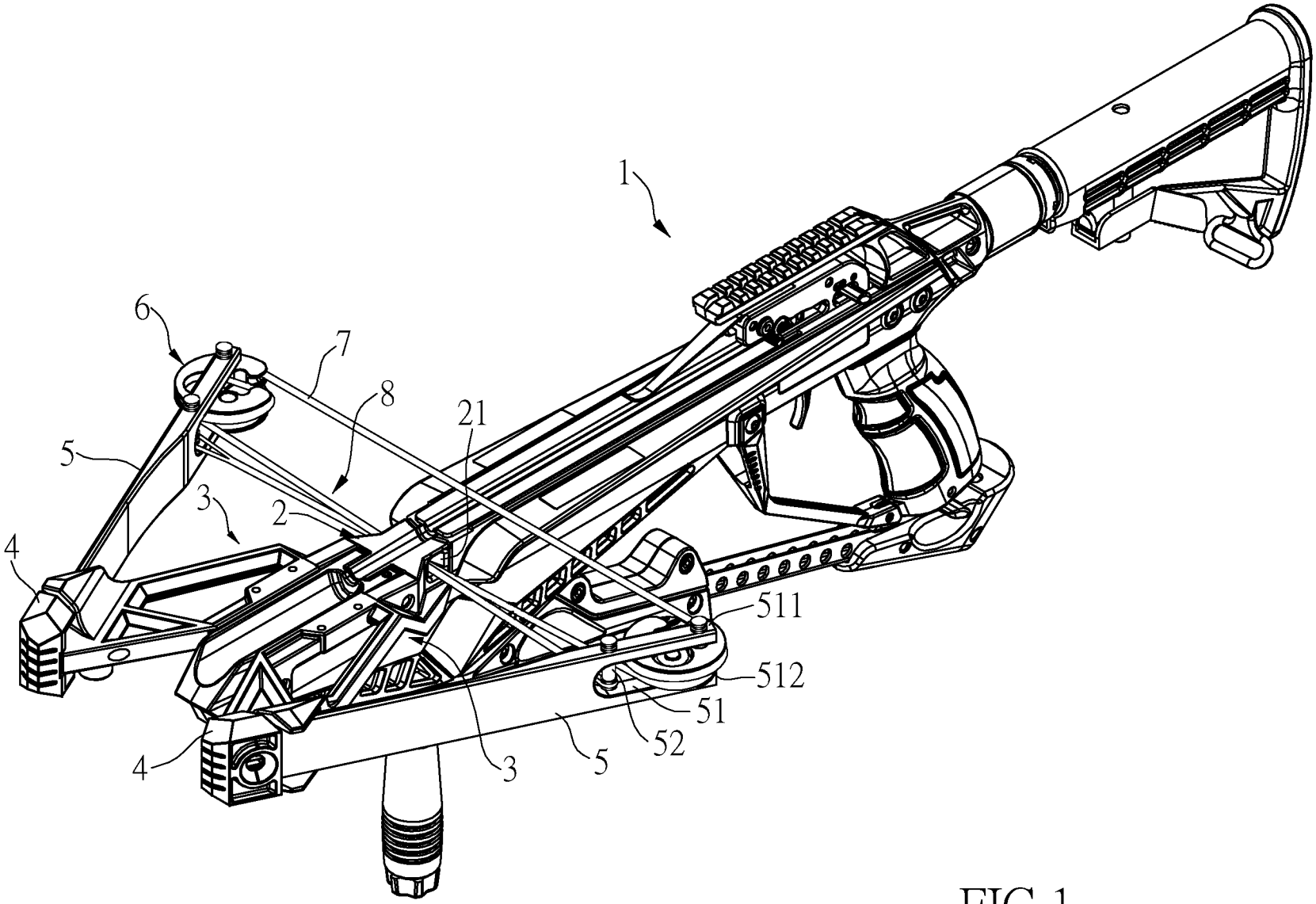
FIG. 1 is a perspective view to show a barrel of a crossbow with the limb and string pack of the present invention.

Referring to FIGS. 1 to 5, the limb and string pack for a crossbow 1 of the present invention comprises a base 2 which is installed to an installation recess 11 defined in the top of the front end of the barrel of the crossbow 1. The installation recess 11 includes two end openings 12 and an open top, so that the base 2 is easily installed into the installation recess 11. The installation recess 11 further includes two lateral lugs 114 which are located corresponding to the two end openings 12.

The base 2 includes a passage 21 which is a transverse passage and communicates with the two end openings 12 of the installation recess 11. A guide groove 22 is defined in the top of the base 2. Two links 3 respectively and integrally extend from the base 2 and extend beyond the two end openings 12 and toward the front end of the barrel of the crossbow 1. Each link 3 actually includes multiple sub-links and a portion of each link 3 is located on two sides of the barrel. Two connection slots 31 are formed between the base 2 and the two links 3. The two lateral lugs 114 are inserted in the two connection slots 31. A pocket 4 is connected to the free end each of the two links 3.

Two limbs 5 are respectively connected to the two pockets 4 and located next to the two links 3. The two limbs 5 each have a split end which includes an upper portion 511 and a lower portion 512, such that a notch 51 is formed between the upper portion 511 and the lower portion 512. Two cams 6 are pivotably installed to the two notches 51 of the two limbs 5. Each cam 6 includes a first groove 61 and a second groove 62 which is located at an axial distance from the first groove 61. A column 52 is connected to the lower portion 512 of each limb 5. A string 7 is connected between the two cams 6 and located above the barrel of the crossbow 1. Two cables 8 respectively extend through the passage 21 of the base 2 and connected to the limbs 5 and the cams 6. The cables 8 extend through the passage 21 of the base 2, and do not affect operation of the string 7.

Specially, the string 7 is connected to the first groove 61 of each of the two cams 6. The two cables 8 includes a first cable 81 and a second cable 82. An end portion 83 is formed on one of two ends of each of the first and second cables 81, 82. The end portion 83 of the first cable 81 is mounted to the column 52 of one of the two lower portions 512, and the other one of the two ends of the first cable 81 extends through the passage 21 of the base 2 and is connected to the second groove 62 of the cam 6 that is located away from the end portion 83 of the first cable 81. The end portion 83 of the second cable 82 is mounted to the column 52 of the other one of the two lower portions 512, and the other one of the two ends of the second cable 82 extends through the passage 21 of the base 2 and is connected to the second groove 62 of the cam 6 that is located away from the end portion 83 of the second cable 82. The first and second cables 81, 82 go across to each other in the passage 21.

When securing the pack to the installation recess 11, a first bolt 9 extends through the two links 3, the barrel of the crossbow 1, the two lateral lugs 114 of the installation recess 11 and the base 2, and is connected with a nut. A second bolt 90 extends through two protrusions 32 of the links 3 and the front end of the barrel of the crossbow 1, and is connected with another nut. The protrusions 32 are rectangular protrusions and located on two sides of the barrel. The base 2 and the two protrusions 32 are located at three peaks of a triangle to secure the base 2 and the two links 3 to the barrel. By the first and second bolts 9, 90, the pack is secured to the barrel of the crossbow 1. The lateral lugs 114 help the assemblers to tell the direction of the pack so as to quickly install the base 2 in the installation recess 11.

Figure 2:
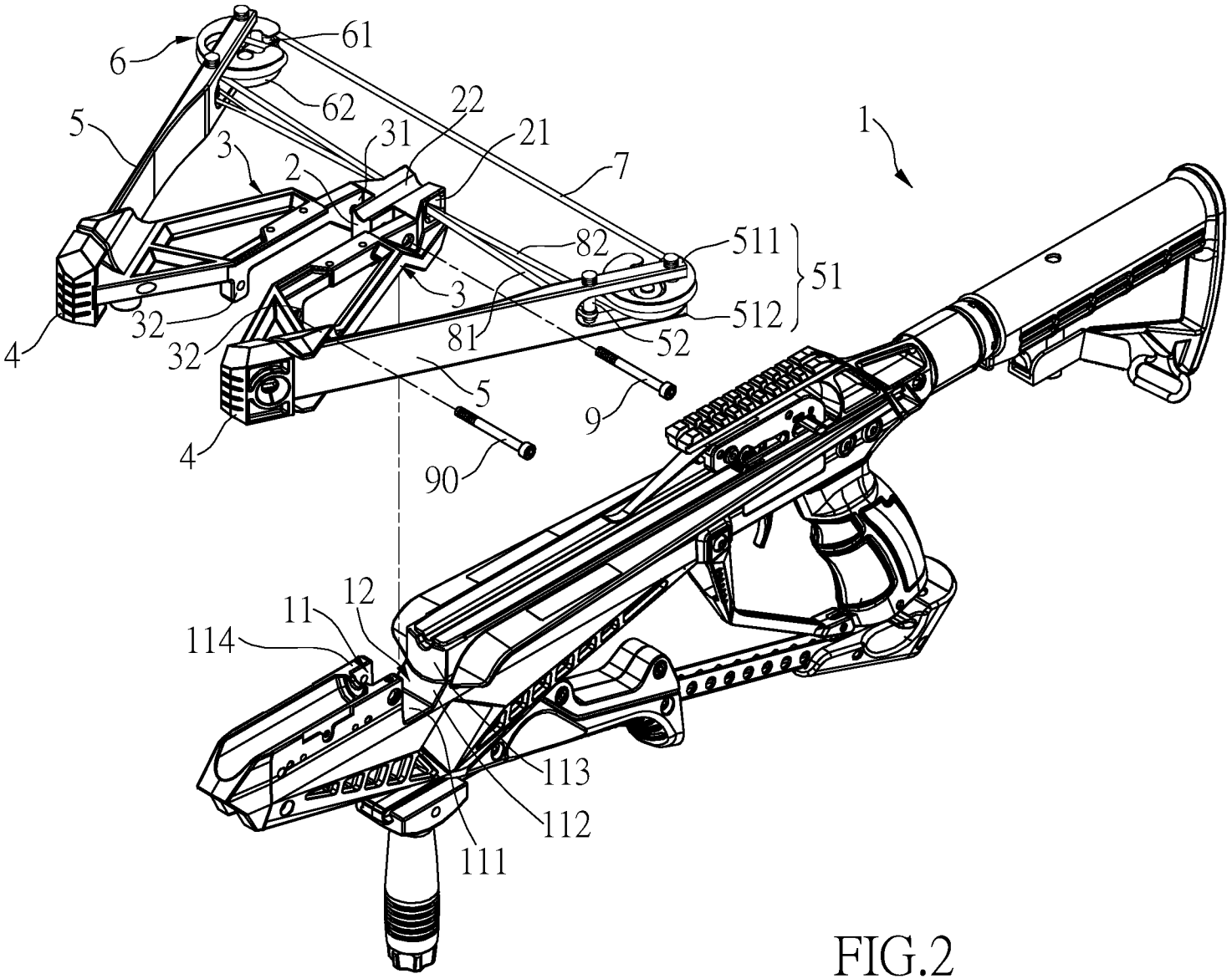
FIG. 2 is an exploded view to show of the limb and string pack of the present invention and the barrel of the crossbow.
Figure 3:
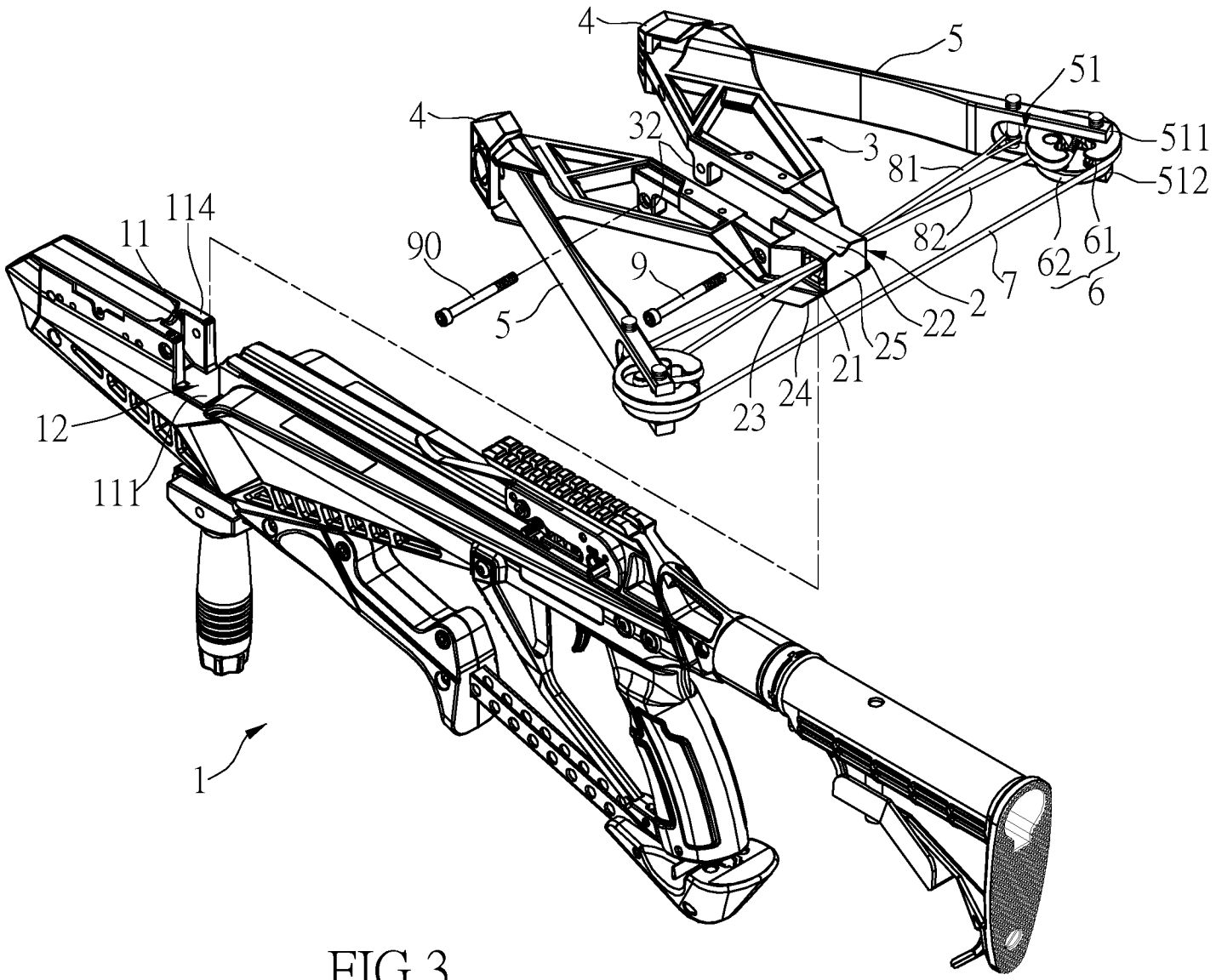
FIG. 3 is another exploded view to show of the limb and string pack of the present invention and the barrel of the crossbow.
Figure 4:
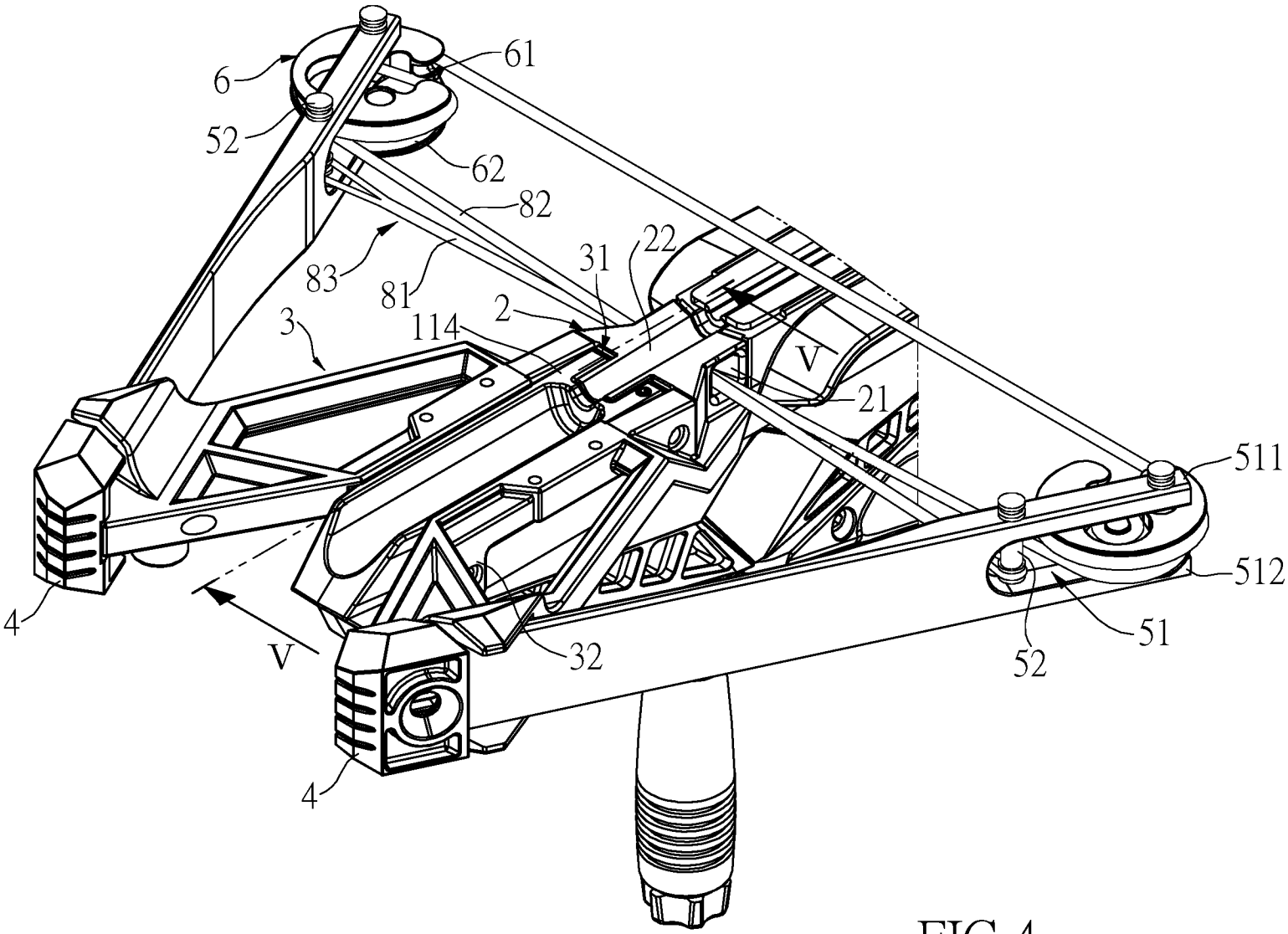
FIG. 4 is a perspective view to show the limb and string pack of the present invention.
Figure 5:
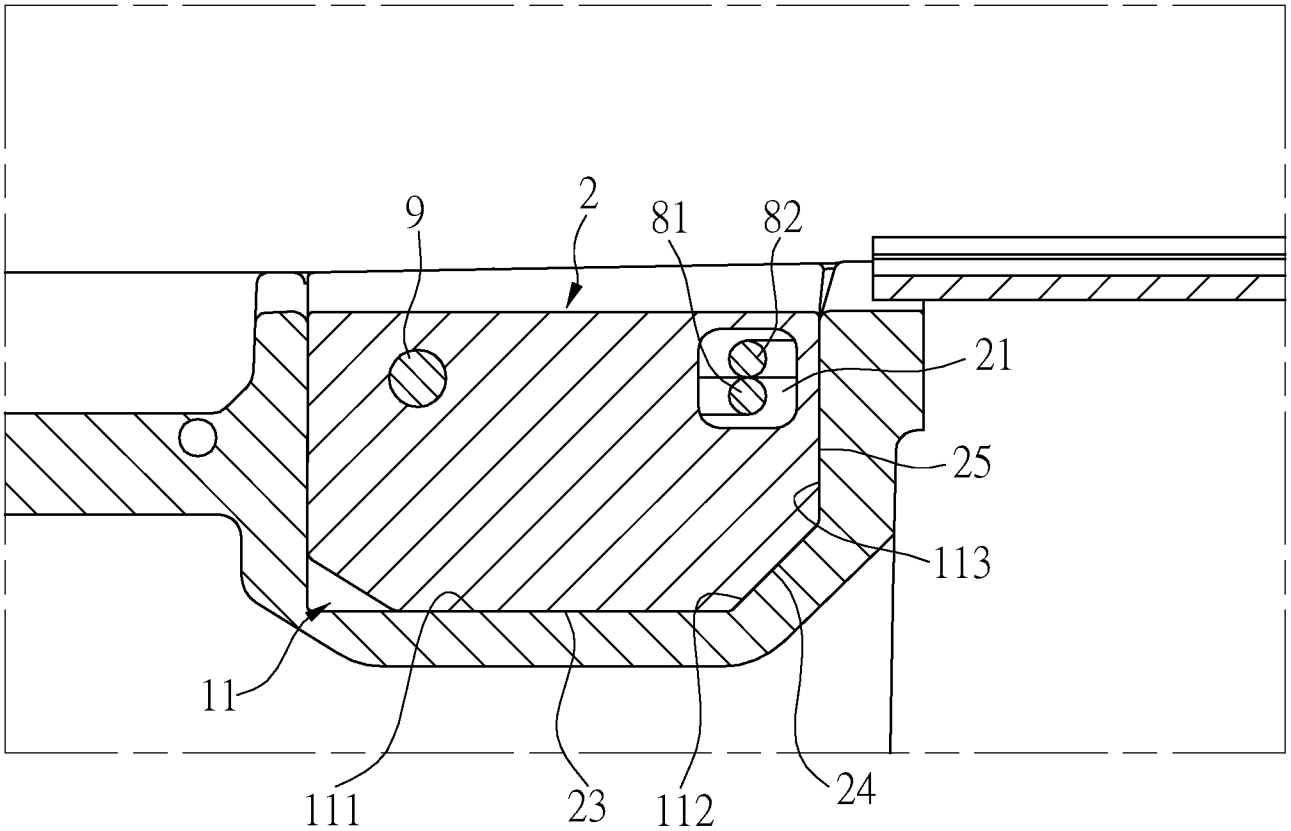
FIG. 5 is a cross sectional view, taken along line V-V in FIG. 4.

As shown in FIGS. 2 and 3, the base 2 and the two links 3 form a bottom face 23, an inclined face 24 extending from one end of the bottom face 23, and an end face 25 extending from one end of the inclined face 24. The installation recess 11 is defined by a first face 111 located corresponding to the bottom face 23, a second face 112 located corresponding to the inclined face 24, and a third face 113 located corresponding to the end face 25. When the base 2 is installed in the installation recess 1, the bottom face 23 matches with the first face 111, the inclined face 24 matches with the second face 112, and the end face 25 matches with the third face 113. The base 2 is stably installed in the installation recess 11.

By using the pack of the present invention, the distance between the trigger of the crossbow 1 and the string 7 can be prolonged when compared with the conventional crossbow. Besides, the distance of the string 7 is increased by the base 2 and the two links 3. The pack can be easily removed from the barrel by unscrewing the first and second bolts 9, 90. The string 7 and the cables 8 are conveniently replaced and maintained.

While we have shown and described the embodiment in accordance with the present invention, it should be clear to those skilled in the art that further embodiments may be made without departing from the scope of the present invention.

What is claimed is:

1. A limb and string pack for a crossbow, comprising:

a base installed to an installation recess defined in a top of a front end of the barrel of the crossbow, the installation recess including two end openings and an open top, the base including a passage which communicates with the two end openings of the installation recess;

two links respectively extending from the base and extending beyond the two end openings and toward the front end of the barrel of the crossbow, a pocket connected to a free end each of the two links;

two limbs connected to the two pockets and located next to the two links;

two cams respectively and pivotably connected to a free end of the two limbs;

a string connected between the two cams and located above the barrel of the crossbow;

two cables respectively extending through the passage of the base and connected to the limbs and the cams, and a first bolt extending through the two links, the barrel of the crossbow, the installation recess and the base, a second bolt extending through the links and the front end of the barrel of the crossbow.

2. The limb and string pack for a crossbow as claimed in claim 1, wherein the base includes a guide groove defined in a top thereof, the base and the two links form a bottom face, an inclined face extending from one end of the bottom face, and an end face extending from one end of the inclined face, the installation recess is defined by a first face located corresponding to the bottom face, a second face located corresponding to the inclined face, and a third face located corresponding to the end face, when the base is installed in the installation recess, the bottom face contacts the first face, the inclined face contacts the second face, and the end face contacts the third face.

3. The limb and string pack for a crossbow as claimed in claim 2, wherein two connection slots are formed between the base and the two links, the installation recess includes two lateral lugs which are located corresponding to the two end openings, the two lateral lugs are inserted in the two connection slots, the first bolt extends through the two lateral lugs and the base.

4. The limb and string pack for a crossbow as claimed in claim 1, wherein two connection slots are formed between the base and the two links, the installation recess includes two lateral lugs which are located corresponding to the two end openings, the two lateral lugs are inserted in the two connection slots, the first bolt extends through the two lateral lugs and the base.

5. The limb and string pack for a crossbow as claimed in claim 1, wherein the two links each have a protrusion, the second bolt extends through the two protrusions and the barrel of the crossbow.

6. The limb and string pack for a crossbow as claimed in claim 5, wherein the two limbs each have a split end which includes an upper portion and a lower portion, a notch is formed between the upper portion and the lower portion, the two cams are pivotably installed to the two notches of the two limbs, each cam includes a first groove and a second groove which is located at an axial distance from the first groove, a column is connected to the lower portion of each limb, the string is connected to the first groove of each of the two cams, the two cables includes a first cable and a second cable, an end portion is formed on one of two ends of each of the first and second cables, the end portion of the first cable is mounted to the column of one of the two lower portions, the other one of the two ends of the first cable extends through the passage of the base and is connected to the second groove of the cam that is located away from the end portion of the first cable, the end portion of the second cable is mounted to the column of the other one of the two lower portions, the other one of the two ends of the second cable extends through the passage of the base and is connected to the second groove of the cam that is located away from the end portion of the second cable, the first and second cables go across to each other in the passage.

* * * * *